US009020630B2

(12) United States Patent
Kaneko et al.

(10) Patent No.: US 9,020,630 B2
(45) Date of Patent: Apr. 28, 2015

(54) SERVO TRANSFER PRESS SYSTEM

(71) Applicant: Aida Engineering, Ltd., Kanagawa (JP)

(72) Inventors: Sotoyuki Kaneko, Hakusan (JP); Osamu Yahata, Yokohama (JP)

(73) Assignee: Aida Engineering, Ltd., Kanagawa (JP)

( * ) Notice: Subject to any disclaimer, the term of this patent is extended or adjusted under 35 U.S.C. 154(b) by 427 days.

(21) Appl. No.: 13/662,059

(22) Filed: Oct. 26, 2012

(65) Prior Publication Data

US 2013/0104613 A1 May 2, 2013

(30) Foreign Application Priority Data

Oct. 26, 2011 (JP) ..... 2011-234858

(51) Int. Cl.

| | |
|---|---|
| ***G06F 19/00*** | (2011.01) |
| ***G01M 1/38*** | (2006.01) |
| ***G05B 13/00*** | (2006.01) |
| ***G05B 15/00*** | (2006.01) |
| ***G05D 23/00*** | (2006.01) |
| ***G05D 1/10*** | (2006.01) |
| ***B30B 15/14*** | (2006.01) |

(52) U.S. Cl.

CPC ..... *B30B 15/148* (2013.01)

(58) Field of Classification Search

CPC ..... B30B 15/30; G05B 19/4061; G05B 2219/35316

USPC ..... 700/178, 206, 275, 302

See application file for complete search history.

(56) References Cited

U.S. PATENT DOCUMENTS

| | | | | |
|---|---|---|---|---|
| 5,231,860 | A | 8/1993 | Tsuruta et al. | |
| 6,845,646 | B2 | 1/2005 | Goto | |
| 7,873,431 | B2 * | 1/2011 | Takahashi et al. | 700/112 |
| 7,891,223 | B2 * | 2/2011 | Kaneko et al. | 72/14.8 |
| 8,096,233 | B2 * | 1/2012 | Kaneko | 100/35 |
| 2003/0004604 | A1 * | 1/2003 | Goto | 700/178 |

(Continued)

FOREIGN PATENT DOCUMENTS

| | | |
|---|---|---|
| JP | 62179829 | 8/1987 |
| JP | 02-089525 A | 3/1990 |
| JP | 03-110031 | 5/1991 |
| JP | 2000158197 A | 6/2000 |
| JP | 2003019527 A | 1/2003 |

(Continued)

OTHER PUBLICATIONS

Notification of Reasons for Refusal issued in Japanese Application No. 2011-234858 dated Apr. 2, 2014, w/English translation.

*Primary Examiner* — Ronald Hartman, Jr.
(74) *Attorney, Agent, or Firm* — McDermott Will & Emery LLP

(57) ABSTRACT

A servo transfer press system generates a press phase signal and a transfer phase signal that are synchronized with a master phase signal, performs a press operation according to a reference press motion based on the press phase signal, and performs a transfer operation according to a reference transfer motion based on the transfer phase signal. The servo transfer press system includes a reference interference diagram generation section, a reference interference diagram storage section, an operation interference diagram generation section, an interference presence/absence comparison-determination section, and a phase signal relative relationship adjustment section, and performs a transfer press operation while avoiding interference by performing an automatic phase signal adjustment when a motion has been changed.

6 Claims, 11 Drawing Sheets

(56) References Cited

U.S. PATENT DOCUMENTS

2006/0169020 A1* 8/2006 Takayama ..... 72/405.1
2008/0295564 A1* 12/2008 Kaneko et al. ..... 72/405.13

FOREIGN PATENT DOCUMENTS

JP 2005-297010 A 10/2005
JP 2008254054 A 10/2008

* cited by examiner

SERVO TRANSFER PRESS SYSTEM

Japanese Patent Application No. 2011-234858, filed on Oct. 26, 2011, is hereby incorporated by reference in its entirety.

BACKGROUND OF THE INVENTION

The present invention relates to a servo transfer press system that includes a servo press that performs press working, and a servo transfer device that transfers a workpiece, and is configured so that a press operation can be performed according to a reference press motion based on a press phase signal that is synchronized with a master phase signal, and a transfer operation can be performed according to a reference transfer motion based on a transfer phase signal that is synchronized with the master phase signal.

A servo transfer press system includes a servo press that performs press working, and a servo transfer device that transfers a workpiece.

The servo press includes a plurality of press-working stations, and performs press working (e.g., punching, bending, or drawing) on the workpiece using a die while moving a slide upward and downward. The slide is moved upward and downward according to a press motion. Note that the workpiece transferred to the first press-working station is a material. A semi-finished product is obtained by each intermediate press-working station, and a product is obtained by the final press-working station. The motion of the slide according to the press motion is referred to as "slide motion".

A press is roughly classified into a non-servo press and a servo press depending on the presence or absence of motion variability. The non-servo press rotates the crank shaft at a constant speed using a synchronous motor or the like, and performs a press operation according to a constant sine-wave press motion. In contrast, the servo press can perform a press operation while setting an arbitrary slide motion by changing the rotation of the crank shaft using a servomotor.

For example, the servo press can perform a press operation according to an operation press motion indicated by the solid line in FIG. 16 in which the slide is set at a position lower than the top dead center position (e.g., a half-stroke symmetrical motion with respect to bottom dead center). In FIG. 16, the horizontal axis indicates time, and the vertical axis indicates the slide position. The working cycle time can be reduced as compared with the non-servo press by reducing the stroke, so that the production efficiency can be significantly improved. Note that the motion indicated by the dotted line in FIG. 16 is a reference press motion when the crank shaft of the servo press is rotated at a constant speed. In this case, the slide position moves along an approximate sine curve with respect to time in the same manner as in the non-servo press.

As illustrated in FIG. 17, the servo press can also perform a press operation according to a press motion in which the slide is temporarily stopped at the desired position during downward movement, and is moved downward again when a given time has elapsed. For example, a magnesium alloy is held by the die heated at a high temperature until the magnesium alloy is heated to the optimum temperature, and is press-worked when the magnesium alloy has reached the optimum temperature, and the die is quickly moved upward after completion of press working. The magnesium alloy can be pressed with high efficiency by utilizing the above press motion instead of the reference press motion.

The transfer device transfers the workpiece to each press-working station. More specifically, the transfer device is configured so that the workpiece is held by a workpiece-holding tool (e.g., finger or cup) provided on a feed bar, and transferred while moving the feed bar in two-dimensional or three-dimensional directions. The feed bar may be referred to as "transfer bar". The transfer device may be driven by a synchronization drive method that causes the transfer device to perform a transfer operation using a drive shaft that can be synchronized with the motion of the press, or a servo transfer drive method that causes the transfer device to perform a transfer operation while setting an arbitrary transfer motion by changing the rotation of the feed shaft using a servomotor. It is advantageous to use the servo transfer drive method from the viewpoint of operation adaptability.

It is necessary to drive the servo press and the servo transfer device in synchronization. A method that causes the servo transfer device to transfer the workpiece in synchronization with the rotation of the crank shaft of the servo press based on the crank shaft angle of the servo press has been employed (see JP-B-7-73750 and JP-B-7-75741). Specifically, the start timing and the end timing of each transfer motion are generated and output based on the rotation angle of the crank shaft (crank shaft angle follow-up method).

However, it is difficult to deal with various press motions (including the press motions illustrated in FIGS. 16 and 17) required for the servo press when using the crank shaft angle follow-up method. Since the crank shaft angle follow-up method causes the servo transfer device to follow the servo press, the press operation directly affects the transfer motion. Specifically, a smooth transfer motion may easily be impaired. Moreover, it takes time to match the press motion and the transfer motion.

In order to solve the above problems, JP-A-2005-297010 proposes a master phase signal synchronization method that causes the servo press to perform a press operation according to a reference press motion based on a press phase signal that is synchronized with the phase velocity of a master phase signal (e.g., process number), and causes the servo transfer device to perform a transfer operation according to a reference transfer motion based on a transfer phase signal that is synchronized with the phase velocity of the master phase signal.

The master phase signal synchronization method makes it possible to ensure that the servo transfer device performs a smooth and reliable transfer motion, and the servo press exhibits satisfactory characteristics (i.e., flexible slide motion characteristics).

The master phase signal synchronization method ensures a stable and smooth transfer press operation after adjusting each phase signal with respect to the master phase signal. However, a further improvement has been desired along with the wide-spread use of the master phase signal synchronization method.

For example, it may be desired to change only the press motion in order to improve the productivity and the product quality. However, when the transfer press operation is performed in a state in which only the press motion is changed, the relative phase relationship between the slide motion and the transfer motion based on the master phase signal changes. In this case, interference may occur between the slide motion and the transfer motion.

In order to prevent interference between the slide motion and the transfer motion, it is necessary to adjust each phase signal with respect to the master phase signal, and change the synchronization setting when implementing the slide motion of the servo press and the transfer motion of the servo transfer device. It is also necessary to check whether or not interference between the slide motion and the transfer motion (i.e., interference between the servo press and the servo transfer device) occurs while operating the servo press and the servo transfer device at a low speed.

Specifically, these operations must be performed before actual operation each time the press motion is changed. Therefore, an improvement in operability and adaptability to multikind and small quantity production has been strongly desired.

The above problems also occur when it is desired to change only the transfer motion, or it is desired to change both the press motion and the transfer motion. Therefore, it has been strongly desired to solve the problems.

SUMMARY

The invention may provide a servo transfer press system that exhibits excellent operability due to the capability to automatically adjust a phase signal when motion has been changed.

According to one aspect of the invention, there is provided a servo transfer press system having a servo press that performs press working and a servo transfer device that transfers a workpiece, generating a press phase signal and a transfer phase signal that are synchronized with a master phase signal, causing the servo press to perform a press operation according to a reference press motion based on the press phase signal, and causing the servo transfer device to perform a transfer operation according to a reference transfer motion based on the transfer phase signal, the servo transfer press system comprising:

a reference interference diagram generation section that generates a reference interference diagram that indicates presence or absence of interference between the servo press and the servo transfer device by using the reference press motion and the reference transfer motion;

a reference interference diagram storage section that stores the reference interference diagram;

an operation interference diagram generation section that generates an operation interference diagram that indicates the presence or absence of interference between the servo press and the servo transfer device by using an operation press motion and an operation transfer motion that have been input before operation;

an interference presence/absence comparison-determination section that compares the operation interference diagram with the reference interference diagram stored in the reference interference diagram storage section, and determines whether or not interference will occur when using the operation interference diagram; and a phase signal relative relationship adjustment section that adjusts a relative relationship between the press phase signal and the transfer phase signal by changing one or both of the operation press motion and the operation transfer motion so that interference will not occur when it has been determined that interference will occur when using the operation interference diagram.

DETAILED DESCRIPTION OF THE EMBODIMENT

Figure 1:
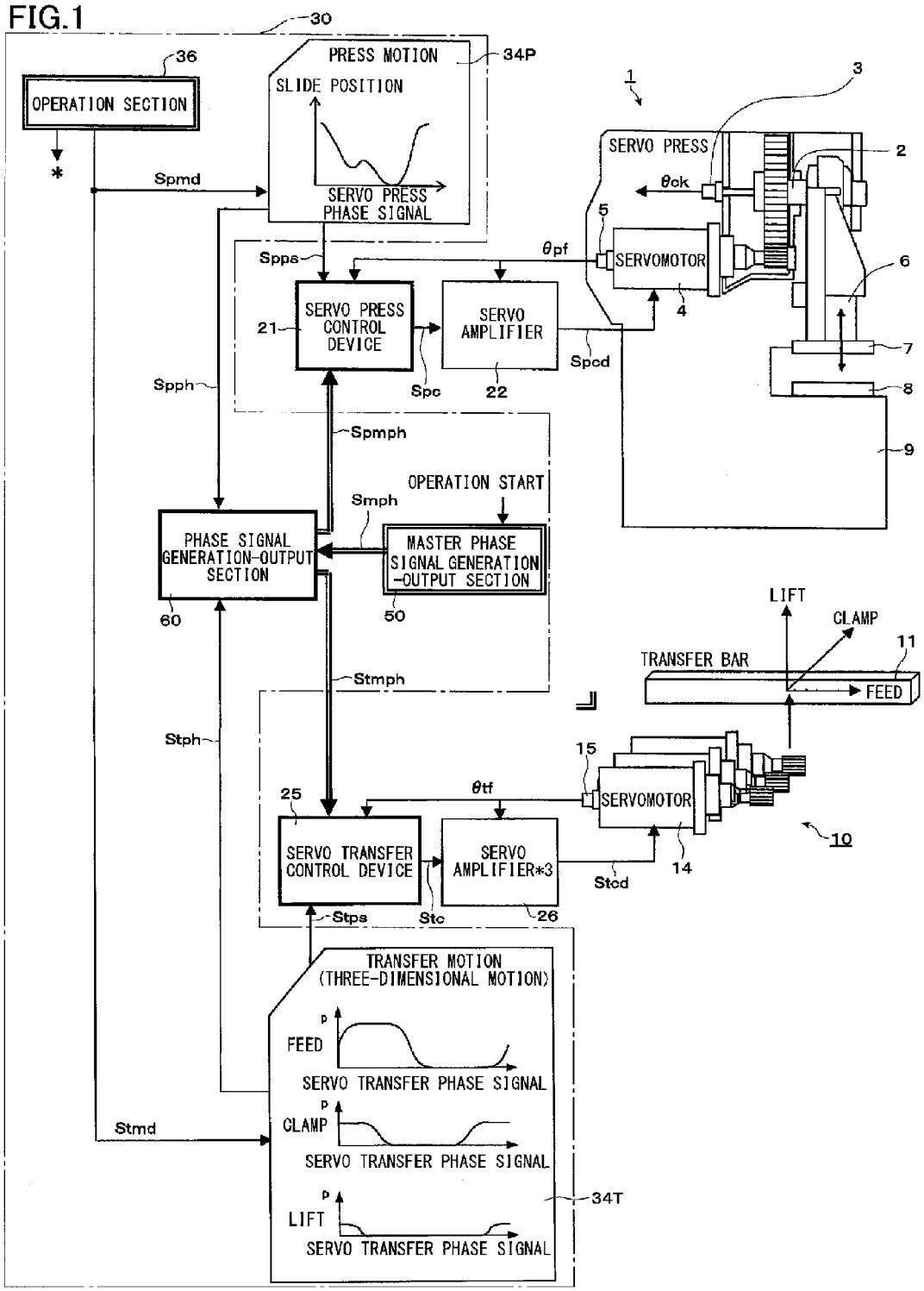
FIG. 1 is a block diagram illustrating the entire servo transfer press system according to one embodiment of the invention.

Several embodiments of the invention may make it possible to generate a reference interference diagram (information) using the results obtained by interference check work that requires visual observation while operating a servo transfer press system at a low speed, generate an operation interference diagram (information) using the estimation results when operating the servo transfer press system according to a transfer press motion that has been changed, and determine whether or not interference occurs by comparing the reference interference diagram and the operation interference diagram. Specifically, several embodiments of the invention may make it unnecessary to perform the above interference check work that takes time, and is performed each time the motion has been changed, and may make it possible to implement a transfer press operation while reliably avoiding interference.

According to one embodiment of the invention, there is provided a servo transfer press system having a servo press that performs press working and a servo transfer device that transfers a workpiece, generating a press phase signal and a transfer phase signal that are synchronized with a master phase signal, causing the servo press machine to perform a press operation according to a reference press motion based on the press phase signal, and causing the servo transfer device to perform a transfer operation according to a reference transfer motion based on the transfer phase signal, the servo transfer press system comprising:

a reference interference diagram generation section that generates a reference interference diagram that indicates presence or absence of interference between the servo press machine and the servo transfer device by using the reference press motion and the reference transfer motion;

a reference interference diagram storage section that stores the reference interference diagram;

an operation interference diagram generation section that generates an operation interference diagram that indicates the presence or absence of interference between the servo press machine and the servo transfer device by using an operation press motion and an operation transfer motion that have been input before operation;

an interference presence/absence comparison-determination section that compares the operation interference diagram with the reference interference diagram stored in the reference interference diagram storage section, and determines whether or not interference will occur when using the operation interference diagram; and a phase signal relative relationship adjustment section that adjusts a relative relationship between the press phase signal and the transfer phase signal by changing one or both of the operation press motion and the operation transfer motion so that interference will not occur when it has been determined that interference will occur when using the operation interference diagram.

It is thus possible to provide a servo transfer press system that exhibits excellent operability due to the capability to automatically adjust the phase signal when the motion has been changed. It is also possible to reliably prevent interference between the servo press and the servo transfer device even if the motion has been arbitrarily changed. It is thus possible to interference between the upper die and the finger.

In the servo transfer press system, the phase signal relative relationship adjustment section may automatically adjust the press phase signal so that a press speed of the servo press changes in a non-interference region with the servo transfer device, but does not change in a press working region.

The servo transfer press system thus ensures a constant press operation speed in the press working region irrespective of the motion setting. This makes it possible to arbitrarily set the motion without taking account of the press working quality. Therefore, the operability can be further improved while achieving stable press working quality.

In the servo transfer press system, the phase signal relative relationship adjustment section may automatically adjust the transfer phase signal so that a transfer speed of the servo transfer device changes in a region other than a workpiece transfer region, but does not change in the workpiece transfer region.

The servo transfer press system thus ensures a constant workpiece transfer operation speed during transfer irrespective of the motion setting. This makes it possible to arbitrarily change the motion without taking account of a change in workpiece transfer conditions. Therefore, the operability can be further improved while achieving a stable workpiece transfer motion.

The servo transfer press system may further include a short stroke determination section that determines whether or not the operation press motion is a short-stroke operation press motion, and a maximum phase velocity setting section that sets a maximum phase velocity of the transfer phase signal that is allowed in the workpiece transfer region, and the phase signal relative relationship adjustment section may automatically change a phase velocity of the transfer phase signal in the workpiece transfer region to the maximum phase velocity when the short stroke determination section has determined that the operation press motion is a short-stroke operation press motion.

The servo transfer press system can thus increase the press motion speed. Moreover, it is possible to arbitrarily set the motion without taking account of avoidance of interference.

In the servo transfer press system, the phase signal relative relationship adjustment section may automatically adjust the press phase signal and the transfer phase signal so that it is possible to maintain a relative positional relationship between a slide height of the servo press immediately after the servo transfer device has held a workpiece, and a slide height of the servo press immediately after the servo transfer device has released a workpiece.

This makes it possible to arbitrarily set the motion without affecting the advanced workpiece transfer setting and taking account of the workpiece transfer motion.

The embodiments of the invention are described in detail below with reference to FIGS. 1 to 15.

Figure 2:
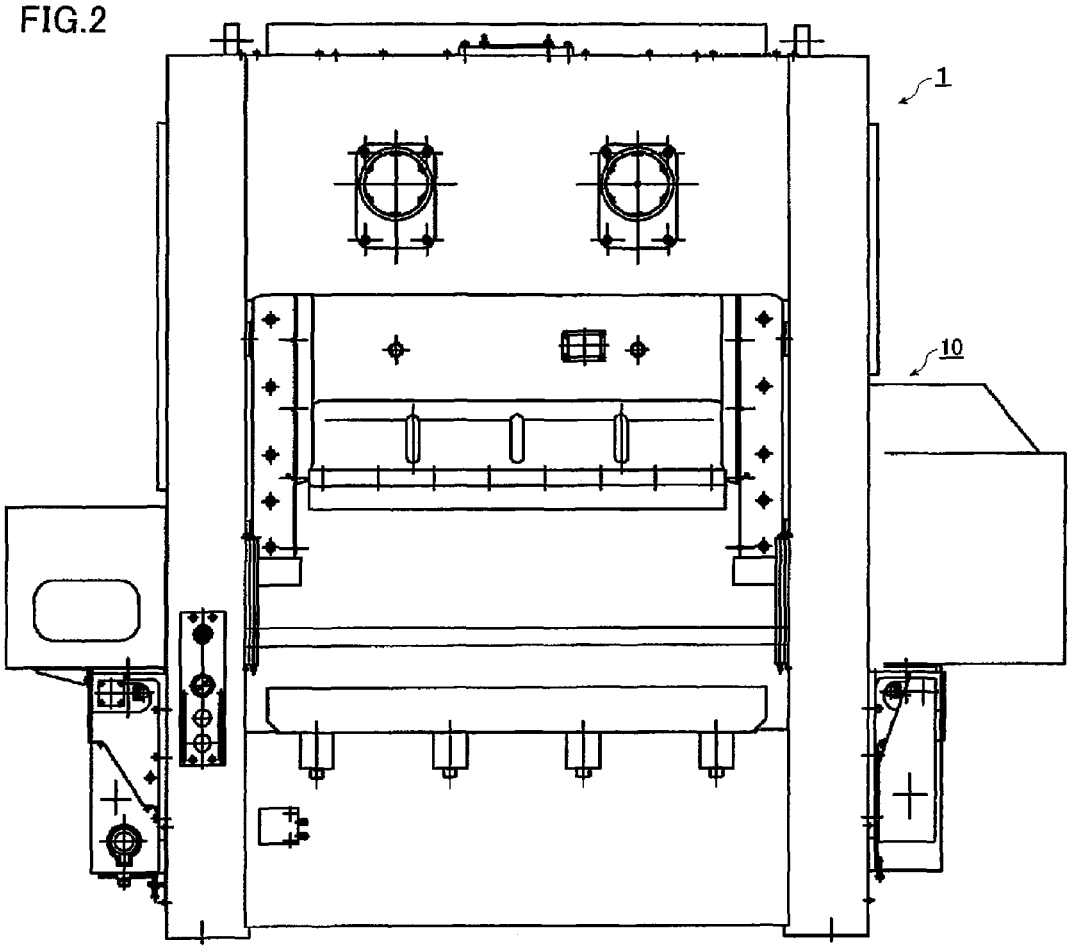
FIG. 2 is a front view illustrating a servo press.
Figure 3:
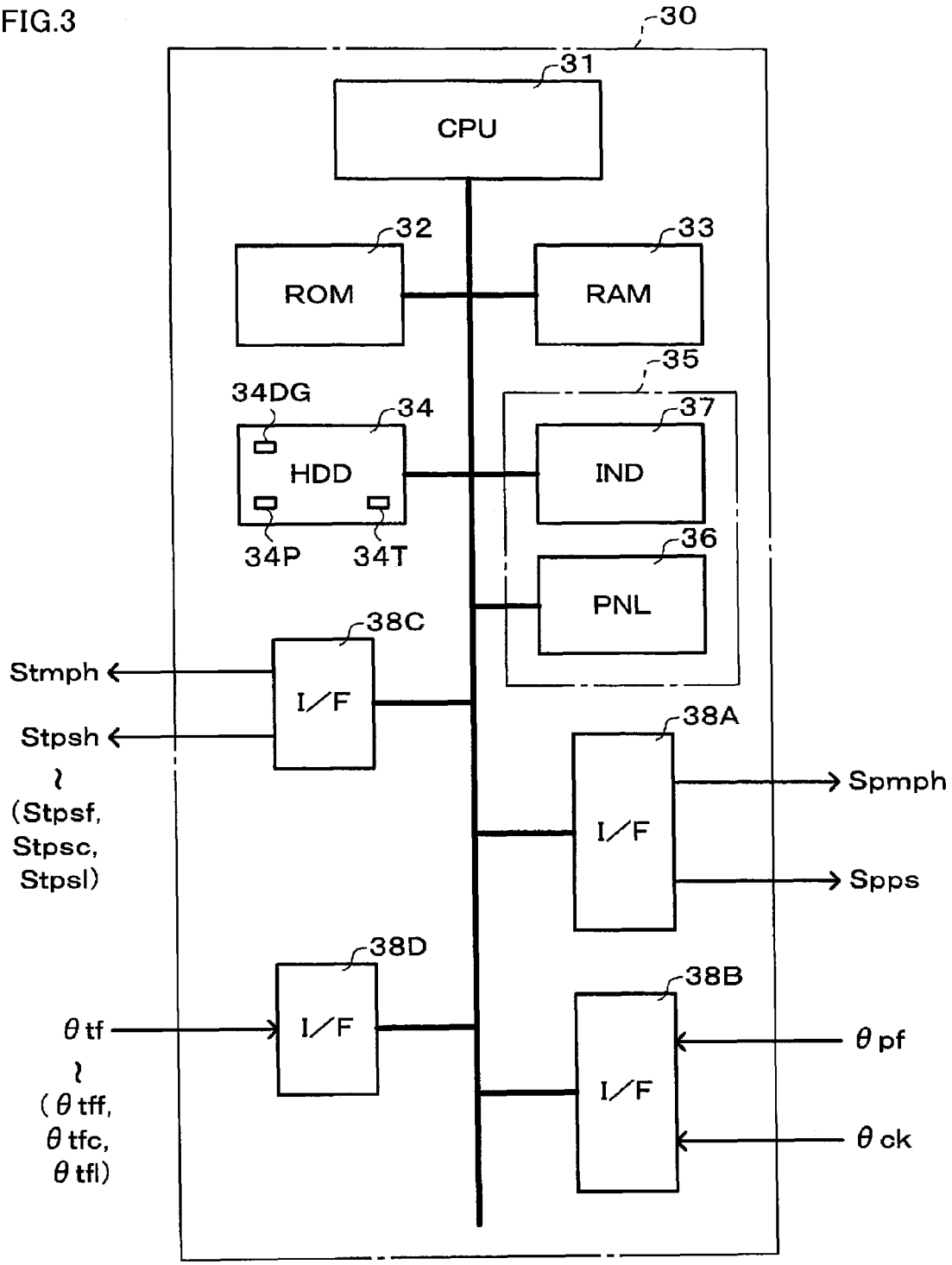
FIG. 3 is a block diagram illustrating a transfer press operation control device.

A servo transfer press system according to one embodiment of the invention includes a servo press 1 that performs press working, and a servo transfer device 10 that transfers a workpiece, and generates a press phase signal Spmph and a transfer phase signal Stmph that are synchronized with a master phase signal Smph, the servo transfer press system being configured so that the servo press 1 can perform a press operation according to a reference press motion BPM based on the press phase signal Spmph, and the servo transfer device 10 can perform a transfer operation according to a reference transfer motion BTM based on the transfer phase signal Stmph, the servo transfer press system being characterized by including a reference interference diagram generation section, a reference interference diagram storage section 34DG, an operation interference diagram generation section, an interference presence/absence comparison-determination section, and a phase signal relative relationship adjustment section, and can perform a transfer press operation while avoiding interference by performing an automatic phase signal adjustment when a motion has been changed (see FIGS. 1 to 3).

Note that the reference interference diagram generation section, the operation interference diagram generation section, the interference presence/absence comparison-determination section, and the phase signal relative relationship adjustment section are implemented by a hard disk drive (HDD) 34 that stores a control program, and a CPU 31 that executes the control program loaded into a RAM 33. This also applies to a master phase signal generation-output section 50, a phase signal generation-output section 60, a post-adjustment operation interference diagram generation section, an interference avoidance check section, a short stroke determination section, and a maximum phase velocity setting section (described later).

As illustrated in FIG. 1 (i.e., a diagram that illustrates the entire system) and FIG. 2 (i.e., a front view that illustrates the servo press 1), a slide 6 that is vertically guided inside a main body 9 is moved upward and downward by a slide drive mechanism that includes a crank shaft 2 and the like. An upper die 7 is secured on the slide 6, and a lower die 8 is secured on a bolster that is disposed on a bed. The distance between the lower side of the slide 6 and the upper side of the bolster (i.e., the relative distance between the upper die 7 and the lower die 8 in the vertical direction) when the slide is positioned at the bottom dead center is referred to as "die height". It is indispensable to maintain a constant die height in order to ensure the accuracy and the quality of the pressed product.

The crank shaft 2 provided in a crown is rotated by a servomotor 4 via a gear mechanism. A crank shaft encoder 3 that detects the rotation angle of the crank shaft 2 is provided to the crank shaft 2. A rotation angle detection signal thetack from the crank shaft encoder 3 is input to a transfer press operation control device 30 (see FIG. 3). The press speed, the current vertical position and the bottom dead center position of the slide 6, and the like can be detected by processing the rotation angle detection signal thetack.

A motor encoder 5 is provided to the servomotor 4. A rotation angle detection signal thetapf from the motor encoder 5 is input to a servo press control device 21 and a servo amplifier 22 for implementing a servo press control process. The rotation angle detection signal thetapf is also input to the transfer press operation control device 30.

As illustrated in FIGS. 1 and 2, the servo transfer device 10 causes a pair of right and left transfer bars 11 to perform a transfer motion using a servomotor 14. Each transfer bar 11 is provided with a tool (e.g., finger, nail-like member, or vacuum cup) for clamping the workpiece. In one embodiment of the invention, each transfer bar 11 is provided with a finger, and performs an unclamp motion UCL, a return motion RTN, a clamp motion CLP, a lift motion LFT (feed motion), an advance motion ADV, and a down motion DWN (see FIG. 6) either simultaneously or in an overlap manner.

A motor encoder 15 (15*f*, 15*c*, 15*l*) is provided to the servomotor 14 (14*f*, 14*c*, 14*l*). In one embodiment of the invention, three servomotors 14 are provided. Note that a plurality of identical elements are indicated by the letters "f", "c", and "l" in parentheses (e.g., servomotor 14 (14*f*, 14*c*, 14*l*)). The letters "f", "c", and "l" respectively correspond to "feed", "clamp", and "lift".

A rotation angle detection signal thetatf (thetatff, thetatfc, thetatfl) from the motor encoder 15 (15*f*, 15*c*, 15*l*) is input to the servo transfer control device 25 (25*f*, 25*c*, 25*l*) and the servo amplifier 26 (26*f*, 26*c*, and 26*l*) for implementing a servo transfer control process. The rotation angle detection signal thetatf (thetatff, thetatfc, thetatfl) is also input to the transfer press operation control device 30.

Note that the servo press 1 and the servo transfer device 10 are not limited to the above configuration and structure. The servo press 1 and the servo transfer device 10 may have an arbitrary configuration and an arbitrary structure.

As illustrated in FIG. 3, the transfer press operation control device 30 includes a CPU 31, a ROM 32, a RAM 33, the HDD 34, a touch panel 35, and interfaces 38A to 38D. The ROM 32 stores an OS, a basic control program, and fixed values. The HDD 34 stores various control programs for implementing the invention. The HDD 34 also stores input (set) data, detection data, and the like. Note that the HDD 34 is used as an example of a nonvolatile memory. Another nonvolatile memory may be used instead of the HDD 34. The touch panel 35 includes an operation section 36 and a display section 37.

The basic functions of the servo transfer press system (i.e., the functions of the master phase signal synchronization method (see JP-A-2005-297010) that can generate the press phase signal Spmph and the transfer phase signal Stmph that are synchronized with the master phase signal Smph, allows the servo press 1 to perform a press operation according to the reference press motion BPM based on the press phase signal Spmph, and allows the servo transfer device 10 to perform a transfer operation according to the reference transfer motion BTM based on the transfer phase signal Stmph) are described below with reference to FIGS. 1 and 3.

The operator inputs press motion creation data Spmd for creating an optimum press motion using the operation section 36. The press motion is created in a graphical form in which the horizontal axis indicates the value of the press phase signal (e.g., 0° to 360°), and the vertical axis indicates the slide position (see FIG. 1). The press motion creation data Spmd is subjected to a smoothing process and the like, and stored in a press motion storage section 34P as a press motion image.

The operator also inputs transfer motion creation data Stmd for creating an optimum workpiece transfer motion. The transfer motion is created in a graphical form in which the horizontal axis indicates the value of the transfer phase signal (e.g., 0° to 360°, and the vertical axis indicates the three-dimensional position (i.e., feed/lift/clamp motion position) of the transfer bar. The transfer motion creation data Stmd is subjected to a smoothing process and the like, and stored in a transfer motion storage section 34T as a transfer motion image.

The data of the input (or stored) press motion is supplied to the servo press control device 21 and the transfer press operation control device 30, and the data of the input (or stored) transfer motion is supplied to the servo transfer control device 25 and the transfer press operation control device 30. The details thereof are described later. The master phase signal generation-output section 50 generates and outputs the master phase signal Smph by utilizing a clock signal output from an oscillation circuit included in the CPU 31. When the transfer press operation has started, the value of the master phase signal Smph repeatedly increases from 0° to 360°. Specifically, the process number increases while the transfer press operation is performed.

In FIG. 1, the master phase signal generation-output section 50 is included in the transfer press operation control device 30. Note that the master phase signal may be supplied to the transfer press operation control device 30 from the outside.

The phase signal generation-output section 60 generates the press phase signal Spmph that is synchronized with the master phase signal Smph from the master phase signal Smph input thereto and the servo press phase signal Spph based on the stored press motion, and outputs the press phase signal Spmph to the servo press control device 21 via the interface 38A.

The phase signal generation-output section 60 generates the transfer phase signal Stmph that is synchronized with the master phase signal Smph from the master phase signal Smph and the transfer phase signal Stph (Stphf, Stphc, Stphl) based on the stored transfer motion, and outputs the transfer phase signal Stmph to the servo transfer control device 25 (25*f*, 25*c*, 25*l*) via the interface 38C.

The servo press control device 21 refers to the press phase signal Spmph that is synchronized with the master phase signal Smph, and the rotation angle detection signal thetapf from the motor encoder 5, and generates a press control signal Spc that causes the actual crank angle to coincide with a calculated crank target angle. The term "calculated crank target angle" refers to a crank target angle that is calculated to uniquely and mechanically correspond to the current slide target position that is calculated from slide position data Spps (i.e., the data of the press motion stored in the press motion storage section 34P). The press control signal Spc generated by the servo press control device 21 is amplified by the servo amplifier 22, and used to drive (rotate) the servomotor 4 as a press drive signal Sped.

The servo transfer control device 25 (25*f*, 25*c*, 25*l*) refers to the transfer phase signal Stmph that is synchronized with the master phase signal Smph, and the rotation angle detection signal thetatf (thetatff, thetatfc, thetatfl) from the motor encoder 15 (15*f*, 15*c*, 15*l*), and generates a transfer control signal Stc (Stcf, Stec, Stcl) that causes the actual motor angle to coincide with a calculated motor target angle.

The term "calculated motor target angle" refers to a motor target angle (feed, clamp, and lift) that is calculated to uniquely and mechanically correspond to the current feed target position, the current clamp target position, or the current lift target position of the transfer bar 11 that is calculated from transfer position data Stps (Stpsf, Stpsc, Stpsl) stored in the transfer motion storage section 34T. The transfer control signal Ste (Stcf, Stcc, Stcl) generated by the servo transfer control device 25 (25*f*, 25*c*, 25*l*) is amplified by the servo amplifier 26 (26*f*, 26*c*, 26*l*), and used to drive (rotate) the servomotor 14 (14*f*, 14*c*, 14*l*) as a transfer drive signal Stcd (Stcdf, Stcdc, Stcdl).

This makes it possible to ensure that the servo transfer device 10 performs a smooth and reliable transfer motion without causing interference, and the slide of the servo press 1 exhibits satisfactory flexible motion characteristics.

Figure 6:
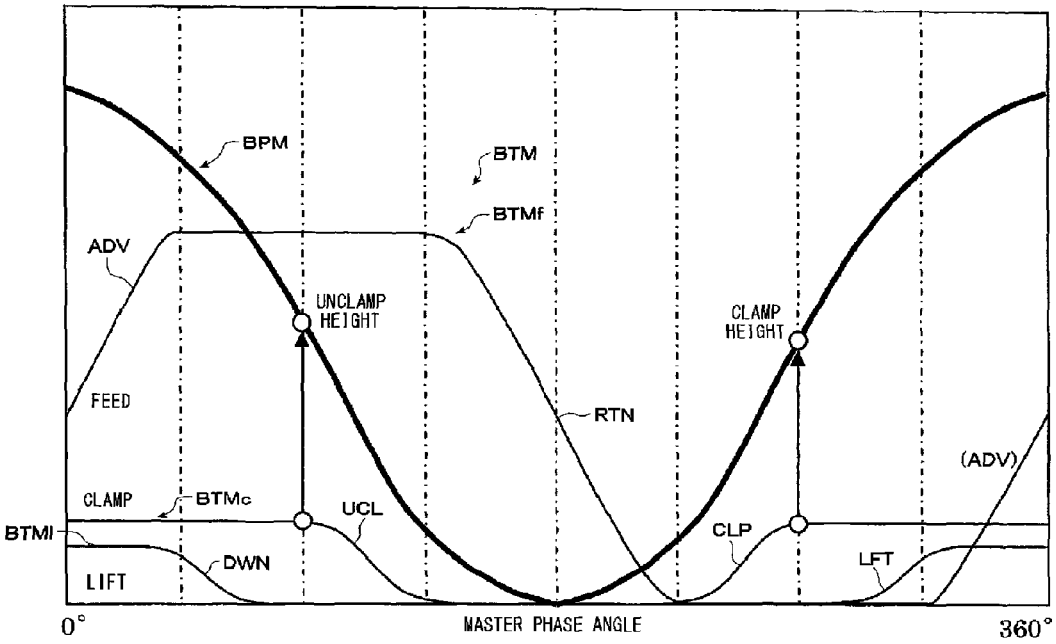
FIG. 6 is a transfer press motion diagram illustrating a reference press motion and a reference transfer motion.

The press motion stored in the press motion storage section 34P and the transfer motion stored in the transfer motion storage section 34T are respectively used as a reference press motion and a reference transfer motion when it has been determined that interference does not occur during the transfer press operation. Therefore, the press motion storage section 34P and the transfer motion storage section 34T also function as a reference press motion storage section and a reference transfer motion storage section, respectively. FIG. 6 illustrates a specific example of a reference press motion BPM and a reference transfer motion BTM (transfer feed motion BTMf, transfer clamp motion BTMc, and transfer lift motion BTMl).

When the press motion and the transfer motion have been input, whether or not interference between the upper die 7 and the transfer bar 11 occurs is determined while a press operation motion based on the press motion and a transfer operation motion based on the transfer motion are performed in synchronization at a low speed until the press motion and the transfer motion are determined to be the reference press motion and the reference transfer motion, respectively. When it has been determined that interference has occurred, or may occur, the transfer motion is repeatedly adjusted by adjusting the phase signal while maintaining the press motion. When it has been determined that interference can be reliably avoided as a result of adjusting the transfer motion, the press motion and the transfer motion are determined to be the reference press motion and the reference transfer motion, respectively.

When it has been determined that interference has occurred, or may occur, the press motion may be repeatedly adjusted while maintaining the maximum-speed transfer motion to avoid interference. In this case, the press motion thus adjusted and the transfer motion are determined to be the reference press motion and the reference transfer motion, respectively.

Specifically, since the check operation and the repeated adjustment operation using the low-speed synchronization operation that takes time must be performed each time the motion has been changed, the operability and the productivity deteriorate. Moreover, the specific characteristics of the servo press 1 may be impaired. The servo transfer press system according to one embodiment of the invention can solve these problems.

The reference interference diagram generation section generates the reference interference diagram that indicates the presence or absence of interference between the servo press 1 and the servo transfer device 10 using the reference press motion and the reference transfer motion. A diagram generation control program is stored in the HDD 34 in advance.

Figure 4:
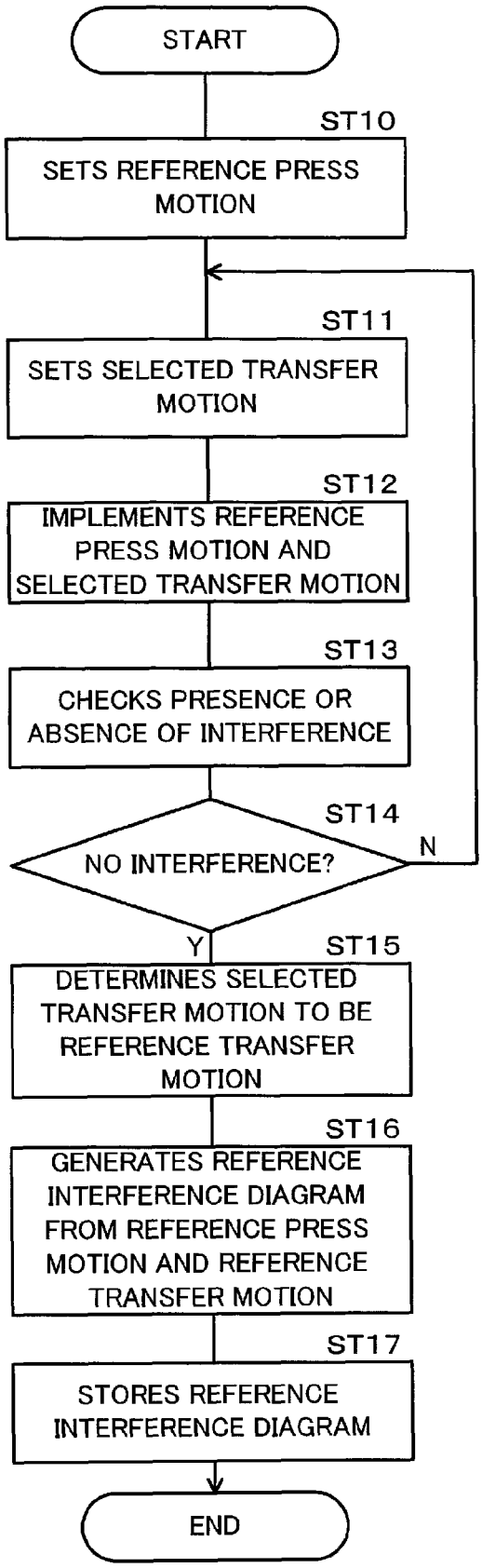
FIG. 4 is a flowchart illustrating a reference interference diagram generation process.

FIG. 4 illustrates a reference interference diagram generation process. In a step ST10 in FIG. 4, the reference press motion is set. For example, the reference press motion (reference press motion BPM illustrated in FIG. 6) stored in the press motion storage section 34P that also functions as the reference press motion storage section is set as the reference press motion. The reference press motion BPM is a reference press motion when the servomotor 4 is constantly rotated at a preset speed. Specifically, the reference press motion BPM is a constant-speed crank shaft motion in which a change in rotational speed does not occur.

The transfer motion is then selected (set). For example, the reference transfer motion (reference transfer motion BTM illustrated in FIG. 6) stored in the transfer motion storage section 34T that also functions as the reference transfer motion storage section is selected as the transfer motion (ST11). The reference transfer motion BTM includes the transfer feed motion BTMf, the transfer clamp motion BTMc, and the transfer lift motion BTM1. In FIG. 6, the advance motion ADV and the return motion RTN are illustrated as the transfer feed motion BTMf, the clamp motion CLP and the unclamp motion UCL are illustrated as the transfer clamp motion BTMc, and the lift motion LFT and the down motion DWN are illustrated as the transfer lift motion BTM1. Each motion occurs in the order "ADV-DWN-UCL-RTN-CLP-LFT-ADV". The workpiece is fed using the transfer bar 11. More specifically, the workpiece is fed using the finger provided to the transfer bar 11.

Again referring to FIG. 4, the transfer press operation is performed at a low speed (or a very low speed) when an operation start instruction has been issued (ST12). The presence or absence of interference is carefully checked by visual observation during the low-speed synchronization operation (ST13). In this case, interference does not occur since the reference transfer motion BTM that does not interfere with the reference press motion BPM has been selected as the transfer motion. The operator issues a signal that indicates the absence of interference using the operation section 36 (YES in ST14). The selected transfer motion is determined to be the reference transfer motion BTM (ST15).

When an arbitrary transfer motion has been selected, and the operator has issued a signal that indicates the presence of interference (NO in ST14), another transfer motion is selected (set) (ST11), and the steps ST12, ST13, and ST14 are repeated.

Figure 7A:
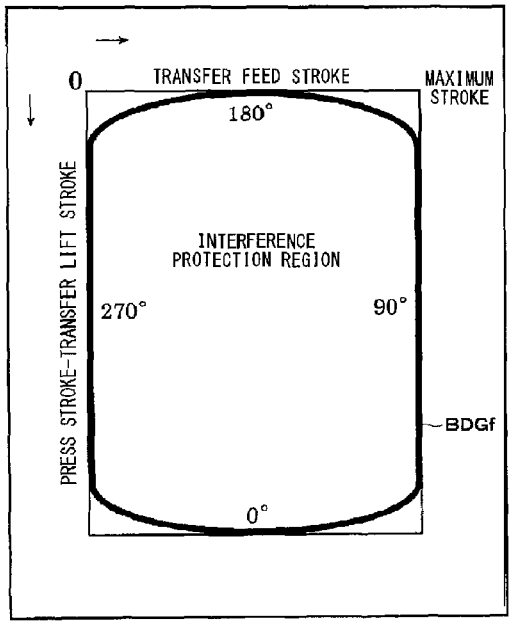
FIGS. 7A and 7B are reference interference diagrams illustrating a reference press motion and a reference transfer motion.
Figure 7B:
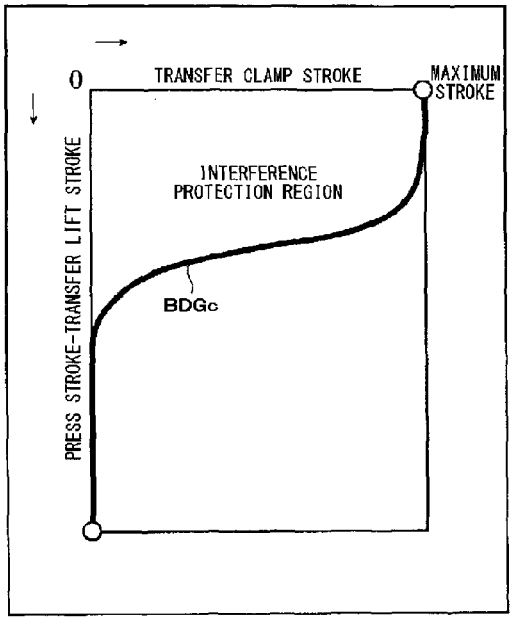

The reference interference diagram generation section generates reference interference diagrams illustrated in FIGS. 7A and 7B using the reference press motion BPM and the reference transfer motion BTM illustrated in FIG. 6 (ST16). The reference interference diagrams BDGf and BDGc thus generated are stored in the reference interference diagram storage section 34DG included in the HDD 34 (ST17).

The reference interference diagram BDGf illustrated in FIG. 7A is a diagram in which the horizontal axis indicates the transfer feed stroke, and the vertical axis indicates the distance obtained by subtracting the transfer lift stroke from the press stroke. The reference interference diagram BDGf indicates the two-dimensional path (baseline Z-direction and workpiece feed direction) of the finger relative to the upper die 7 when viewed from the front side of the servo press 1 (see FIG. 2). The region inside the reference interference diagram BDGf is an interference protection region. The workpiece feed direction refers to the transverse (right-left) direction in FIG. 2.

The horizontal axis indicates the distance that ranges from "0" (left) to "maximum" (right). The vertical axis indicates the distance that ranges from "0" (top) to "maximum" (bottom) taking account of the relationship with FIGS. 13A and 13B. This also applies to FIGS. 9A and 9B.

The reference interference diagram BDGc illustrated in FIG. 7B is a diagram in which the horizontal axis indicates the transfer clamp stroke, and the vertical axis indicates the distance obtained by subtracting the transfer lift stroke from the press stroke. The reference interference diagram BDGc indicates the two-dimensional path (baseline Z-direction and workpiece clamp direction) of the finger relative to the upper die 7 when viewed from the side of the servo press 1 (see FIG. 2). The region above the reference interference diagram BDGc is an interference protection region. The workpiece clamp direction refers to the depth direction in FIG. 2.

The reference interference diagram BDGc indicates the right half in the workpiece clamp direction. The finger conceptually advances into (enters) the servo press 1 when the distance obtained by subtracting the transfer lift stroke from the press stroke is long, and retreats from the servo press 1 when the distance obtained by subtracting the transfer lift stroke from the press stroke is short.

The left half is line-symmetrical with the right half with respect to the baseline Z of the servo press 1 (see FIG. 2). A three-dimensional space is formed by combining the reference interference diagrams illustrated in FIGS. 7A and 7B. This also applies to FIGS. 9A and 9B and FIGS. 13A and 13B.

When the press motion and/or the transfer motion has been changed during the actual transfer press operation, the positional relationship between the upper die 7 of the servo press 1 and the finger of the servo transfer device 10 changes. Specifically, operation interference diagrams ADGf and ADGc (described later) change to differ from the reference interference diagrams BDGf and BDGc (upper die interference diagrams) illustrated in FIGS. 7A and 7B. It can be determined that the upper die 7 interferes with the finger or the transfer bar 11 when the operation interference diagram overlaps the interference protection region indicated by the reference interference diagram.

Figure 5:
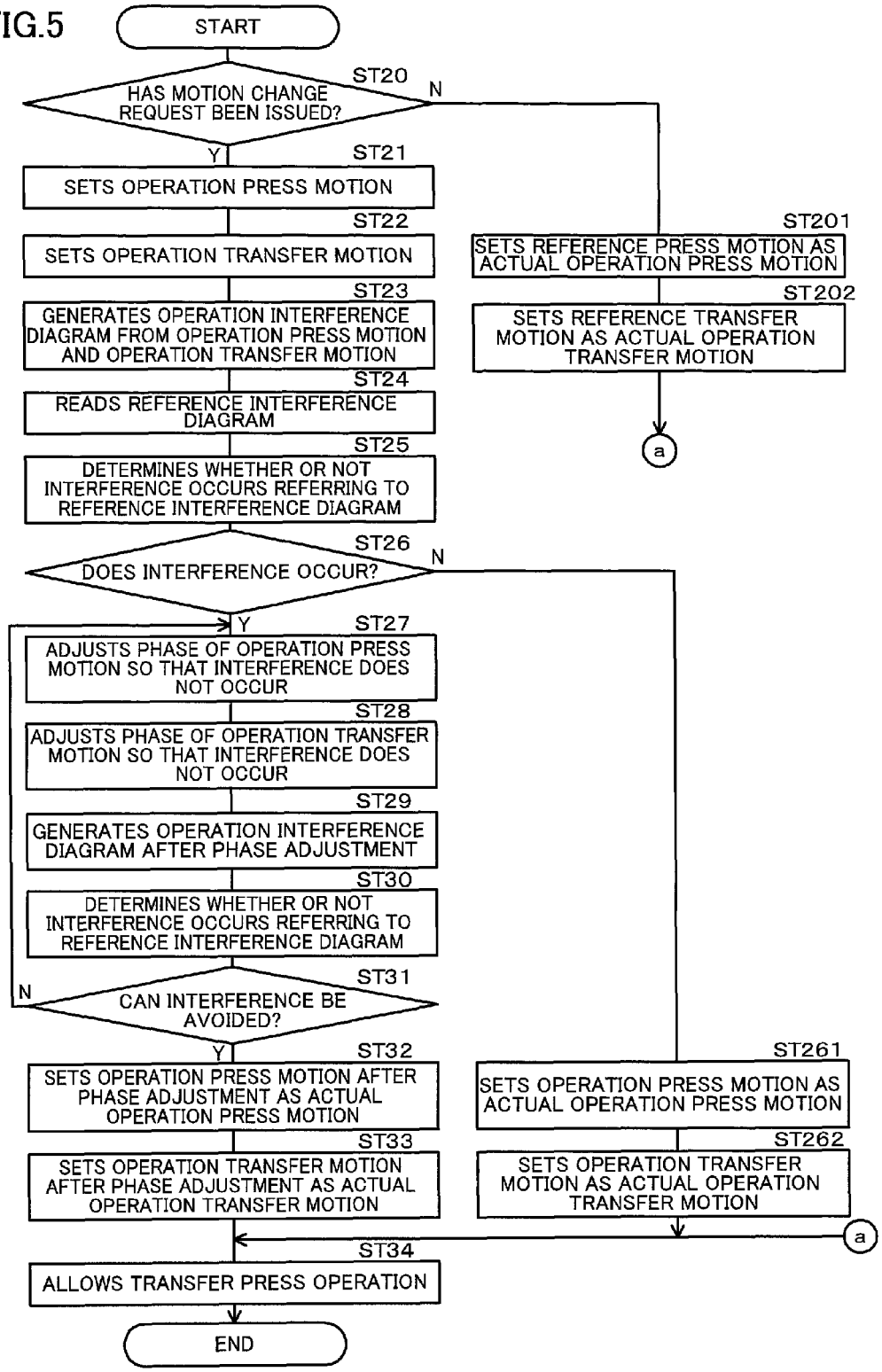
FIG. 5 is a flowchart illustrating an operation interference diagram generation process and an interference avoidance process.

As illustrated in FIG. 5, the motion is set after a motion change request has been issued before the actual transfer press operation (YES in ST20). The operator normally desires to change only the operation press motion from the viewpoint of product quality and production efficiency. However, the operator may desire to change only the operation transfer motion in order to more stably hold the workpiece, or may desire to change both the operation press motion and the operation transfer motion.

The servo transfer press system according to one embodiment of the invention is configured so that it is possible to set the operation press motion (ST21) and the operation transfer motion (ST22). The operation interference diagram is generated on condition that at least one operation motion has been input.

The operation interference diagram generation section generates the operation interference diagram that indicates the presence or absence of interference between the servo press 1 and the servo transfer device 10 using the operation press motion and the operation transfer motion that have been input before operation.

When only the operation press motion has been set, the operation interference diagram generation section generates the operation interference diagram using the input operation press motion instead of the reference press motion while taking account of the relationship with the reference transfer motion. The reference transfer motion is changed (adjusted) until interference does not occur. A transfer motion that can avoid interference is used as the operation transfer motion.

Note that the selected (input) press motion is not necessarily used as the operation press motion. The motion within another region may be changed (e.g., the press speed may be increased) as long as the objective for changing the press motion (e.g., suspension) is achieved. In this case, the overall advantages can be improved if the operation transfer motion is not adversely affected while providing an allowance.

When only the operation transfer motion has been set, the operation interference diagram generation section generates the operation interference diagram using the input operation transfer motion instead of the reference transfer motion while taking account of the relationship with the reference press motion. The reference press motion is changed (adjusted) until interference does not occur. A press motion that can avoid interference is used as the operation press motion.

Note that the selected (input) transfer motion is not necessarily used as the operation transfer motion. The motion within another region may be changed (e.g., the speed of the feed motion may be increased) as long as the objective for changing the transfer motion (e.g., the speed of the clamp motion is made constant) is achieved. In this case, the overall advantages can be improved if the operation press motion is not adversely affected while providing an allowance.

When both the operation press motion and the operation transfer motion have been set, priority is given to the process performed when only the operation press motion has been set, and the process performed when only the operation transfer motion has been set is performed when the operation transfer motion of the servo transfer device 10 has become a maximum as to performance and capacity. The operator may set such a procedure in advance using the operation section.

The operation interference diagram generation section generates the operation interference diagrams using the operation press motion (ST21) and/or the operation transfer motion (ST22) input before operation (ST23). The operation interference diagrams (see FIGS. 9A and 9B, for example) correspond to the reference interference diagrams illustrated in FIGS. 7A and 7B. The operation interference diagrams are generated in the same manner as the reference interference diagrams (ST16 in FIG. 4) (ST23 in FIG. 5).

The interference presence/absence comparison-determination section compares the generated operation interference diagram with the stored (read) reference interference diagram, and determines whether or not interference occurs when using the generated operation interference diagram (ST26). The interference presence/absence comparison-determination section determines that interference occurs when part or the entirety of the three-dimensional or two-dimensional space based on the operation interference diagram enters the three-dimensional or two-dimensional space based on the reference interference diagram.

When the interference presence/absence comparison-determination section has determined that interference does not occur (NO in ST26), the operation press motion or the reference press motion is set as the actual operation press motion, and the operation transfer motion or the reference transfer motion is set as the actual operation transfer motion to allow the transfer operation (ST261, ST262, and ST34).

When the motion change request has not been issued (NO in ST20), the reference press motion is set as the actual operation press motion, and the reference transfer is set as the actual operation transfer motion to allow the transfer operation (ST201, ST202, and ST34).

When it has been determined that interference occurs when using the generated operation interference diagram (YES in ST26), the phase signal relative relationship adjustment section adjusts the relative relationship between the press phase signal Spmph and the transfer phase signal Stmph by changing one or both of the operation press motion and the operation transfer motion so that interference does not occur (ST27 and ST28).

The post-adjustment operation interference diagram generation section generates the operation interference diagram using the operation press motion (ST27) and/or the operation transfer motion (ST28) after the phase signal has been adjusted (ST29). The interference avoidance check section compares the operation interference diagram after the phase signal has been adjusted with the reference interference diagram, and determines whether or not interference can be avoided by the operation interference diagram (ST31). When it has been determined that interference occurs (NO in ST31), the phase signal adjustment step (ST27 and ST28), the operation interference diagram generation step (ST25), and the check step (ST30 and ST31) are repeated.

When it has been determined that interference does not occur (YES in ST31), the operation press motion after the phase signal has been adjusted is set as the actual operation press motion, and the operation transfer motion after the phase signal has been adjusted is set as the actual operation transfer motion to allow the transfer operation (ST32, ST33, and ST34).

The phase signal relative relationship adjustment section can automatically adjust the press phase signal Spmph so that the press speed changes in the non-interference region with the servo transfer device 10, but does not change in the press working region. This makes it possible to take account of the situation in the press working region while allowing a change in speed so that the workpiece transfer region is not affected, or provide the workpiece transfer region with an allowance for a change in speed.

The adjustment function is enabled when a quality priority declaration that gives priority to the stability of the press working quality has been issued using the operation section 36. Note that the adjustment function may always be enabled, and may be temporarily disabled when an exclusion declaration that gives priority to the relative relationship adjustment has been issued.

The phase signal relative relationship adjustment section can automatically adjust the transfer phase signal Stmph (Stmphf, Stmphc, Stmphl) so that the transfer speed changes in the region other than the workpiece transfer region, but does not change in the workpiece transfer region. This makes it possible to take account of the situation in the workpiece transfer region so that the workpiece transfer region is not affected, or provide press working with an allowance for a change in speed.

The adjustment function is enabled when a transfer stability priority declaration that gives priority to the stability of the workpiece transfer motion has been issued using the operation section 36. Note that the adjustment function may always be enabled, and may be temporarily disabled when an exclusion declaration that gives priority to the relative relationship adjustment has been issued.

The phase signal relative relationship adjustment section can automatically change the phase velocity of the transfer phase signal Stmph in the workpiece transfer region to the maximum phase velocity when it has been determined that the operation press motion is a short-stroke operation press motion. Specifically, since the press speed is determined taking account of the press working quality, the press working mode, and the like, the servo transfer device 10 may not be operated at maximum capacity. In other words, since the servo transfer device 10 is not necessarily always driven with the maximum load, an increase in production speed due to a short-stroke press motion can be implemented by effectively utilizing the remaining capacity. The phase signal relative relationship adjustment function is enabled when a short-stroke press operation declaration has been issued using the operation section 36.

In order to implement the above function, the servo transfer press system includes a short stroke determination section that determines whether or not the operation press motion is a short-stroke operation press motion, and a maximum phase velocity setting section that sets the maximum phase velocity of the transfer phase signal that is allowed in the workpiece transfer region. The maximum phase velocity is input using the operation section 36, and stored in a memory or the HDD 34.

The phase signal relative relationship adjustment section can automatically adjust the press phase signal Spmph and the transfer phase signal Stmph so that it is possible to maintain the relative positional relationship between the slide height of the servo press 1 immediately after the servo transfer device 10 has held the workpiece, and the slide height of the servo press 1 immediately after the servo transfer device 10 has released the workpiece. This makes it possible to deliver the workpiece more reliably and stably.

The relative positions of the clamp position and the unclamp position when the servo press 1 and the servo transfer device 10 perform the workpiece transfer motion are made constant when the upper die 7 to which the workpiece is transferred using a pilot pin has been installed, for example. The above function is enabled when a workpiece transfer position matching declaration has been issued using the operation section 36. This makes it possible to reduce the control load and simplify the control process in the same manner as in the case of issuing the short-stroke press operation declaration.

The advantageous effects and the operation of the servo transfer press system according to one embodiment of the invention are described below.

The upper die 7 and the lower die 8 are secured on the servo press 1 so that press working can be implemented. The finger is attached to the transfer bar 11 so that the workpiece can be transferred.

When the motion change request has not been issued (NO in ST20 in FIG. 5), the reference press motion BPM stored in the press motion storage section 34P that also functions as the reference press motion storage section is set as the actual operation press motion (ST201), and the reference transfer motion BTM (BTMf (feed), BTMc (clamp), BTM1 (lift)) stored in the transfer motion storage section 34T that also functions as the reference transfer motion storage section is set as the actual operation transfer motion (ST202) to allow the transfer press operation (ST34). Specifically, the servo transfer press system can be operated using the reference transfer press motion illustrated in FIG. 6 for which it has been determined that interference does not occur. Interference does not occur when using the reference interference diagrams illustrated in FIGS. 7A and 7B.

When the motion change request has been issued (YES in ST20), the operation press motion APM is set (ST21), and the operation transfer motion ATM is set (ST22). When a new operation transfer motion ATM is not set, the reference transfer motion BTM stored in the transfer motion storage section 34T that also functions as the reference transfer motion storage section is used as the operation transfer motion ATM.

The operation interference diagram generation section then generates the operation interference diagram ADG using the operation press motion APM and the reference transfer motion BTM or the input operation transfer motion ATM (ST23).

The interference presence/absence comparison-determination section compares the generated operation interference diagram ADG with the reference interference diagram BDG read from the reference interference diagram storage section 34DG, and determines whether or not interference occurs when using the generated operation interference diagram ADG (ST24, ST25, and ST26).

When it has been determined that interference does not occur (NO in ST26), the operation press motion APM is set as the actual operation press motion, and the reference transfer motion BTM or the operation transfer motion ATM is set as the actual operation transfer motion to allow the transfer press operation (ST261, ST262, and ST34).

When it has been determined that interference occurs when using the generated operation interference diagram ADG (YES in ST26), the phase signal relative relationship adjustment section adjusts the relative phase of the transfer phase signal Stmph by changing the input operation transfer motion ATM so that interference with the reference press motion BPM does not occur (ST28).

Note that it may be necessary to adjust the press phase signal Spmph for the operation press motion APM after the adjustment of the relative phase of the transfer phase signal Stmph has reached a limit (ST27). Specifically, one or both of the operation press motion APM and the operation transfer motion ATM are changed so that interference does not occur.

After the phase signal has been adjusted, the operation interference diagram generation section generates the operation interference diagram ADG using the adjusted operation press motion APM and the reference transfer motion BTM (or the adjusted operation transfer motion ATM) (ST29). The interference avoidance check section compares the generated operation interference diagram ADG with the reference interference diagram BDG read from the reference interference diagram storage section 34DG, and determines whether or not interference can be avoided using the generated operation interference diagram ADG (ST30 and ST31).

When it has been determined that interference can be avoided (YES in ST31), the operation press motion APM after the phase signal has been adjusted is set as the actual operation press motion, and the reference transfer motion BTM or the operation transfer motion ATM is set as the actual operation transfer motion to allow the transfer press operation (ST32, ST33, and ST34).

When it has been determined that interference cannot be avoided using the generated operation interference diagram ADG (NO in ST31), the phase signal relative relationship adjustment section adjusts the relative phase of the transfer phase signal Stmph by changing the operation transfer motion ATM or the reference transfer motion BTM so that interference does not occur (ST27 to ST30). The above steps are repeated until an operation interference diagram ADG that does not cause interference is generated.

First Embodiment

In a first embodiment, the press motion (e.g., the reference press motion BPM) is changed (e.g., the press speed is decreased at around bottom dead center) as illustrated in FIGS. 8 to 11.

Figure 8:
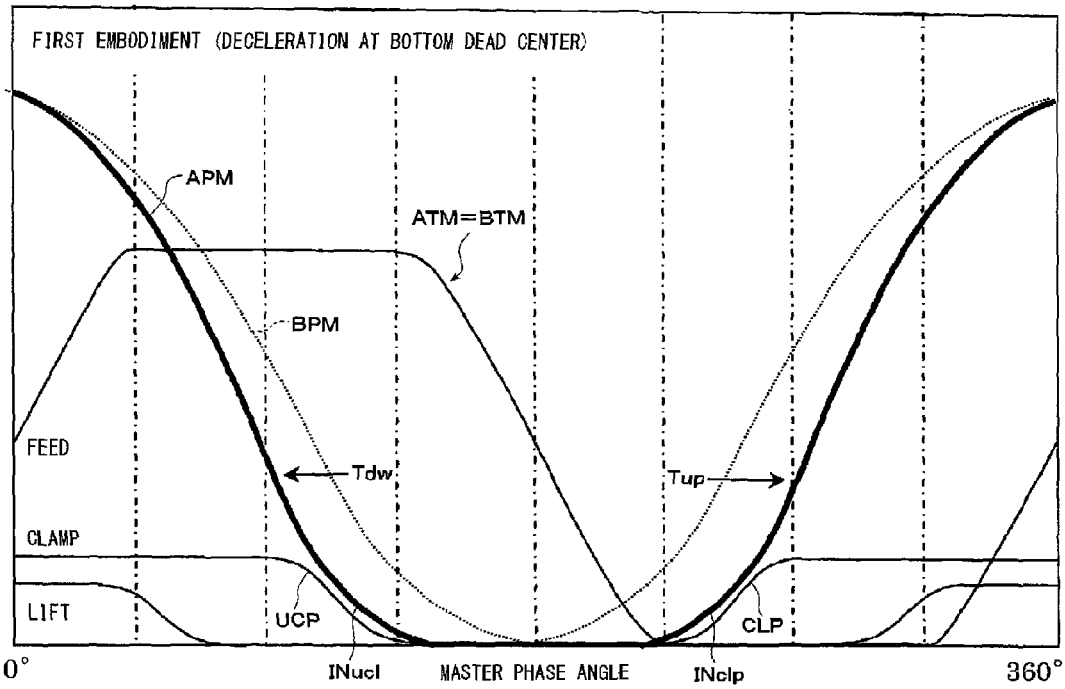
FIG. 8 is a transfer press motion diagram illustrating an operation press motion according to a first embodiment.

An operation press motion that decreases the press speed at around the bottom dead center is set (NO in ST20 and ST21 in FIG. 5). As illustrated in FIG. 8, the operation press motion APM indicated by the solid line is designed so that the time in which the press speed decreases at around bottom dead center position of the slide 6 increases (see arrows Tdw and Tup) as compared with the reference press motion BPM indicated by the dotted line. The operation transfer motion ATM is the same as the reference transfer motion BTM illustrated in FIG. 6.

Figure 9A:
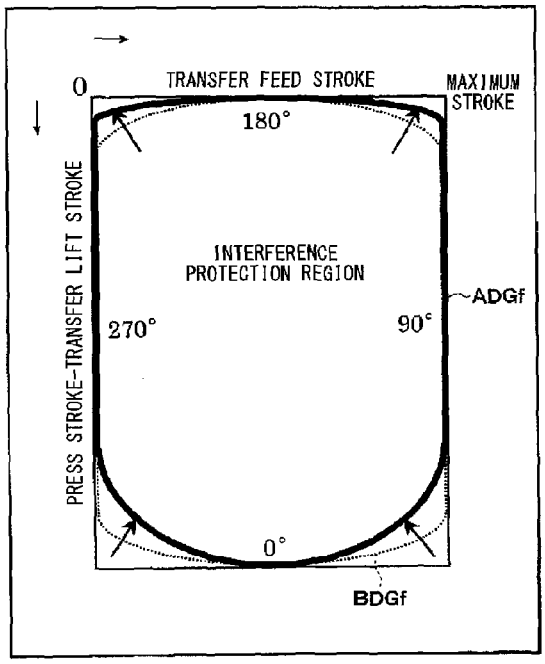
FIGS. 9A and 9B are operation interference diagrams according to the first embodiment.
Figure 9B:
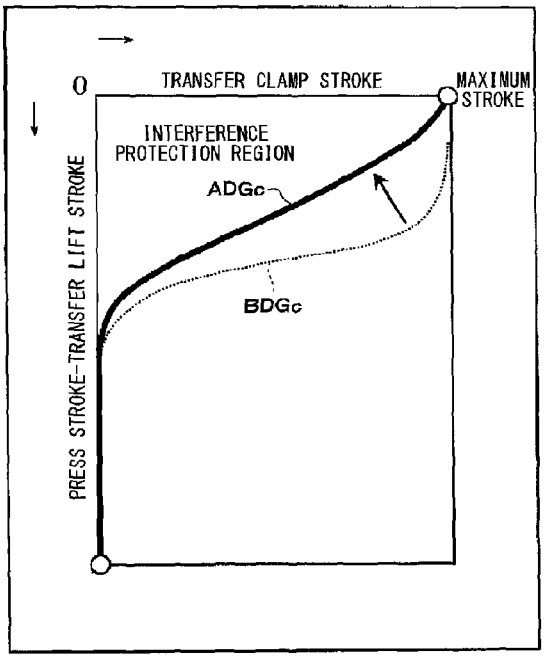

The operation interference diagrams ADGf and ADGc (indicated by the solid line) illustrated in FIGS. 9A and 9B are then generated. The diagrams indicated by the dotted line are the same as the reference interference diagrams BDGf and BDGc indicated by the solid line in FIGS. 7A and 7B. Specifically, since the operation interference diagram ADGc significantly overlaps the interference protection region indicated by the reference interference diagram BDGc (see FIG. 9B), interference between the servo press 1 and the servo transfer device 10 occurs. This is also evident from the fact that interference avoidance clearances INucp and INclp illustrated in FIG are very small. In this case, the interference presence/absence comparison-determination section determines that interference may occur (YES in ST26).

The phase signal relative relationship adjustment section adjusts the relative phase of the transfer phase signal Stmph by changing the input operation transfer motion ATM so that interference with the reference press motion BPM does not occur (ST28).

Figure 10:
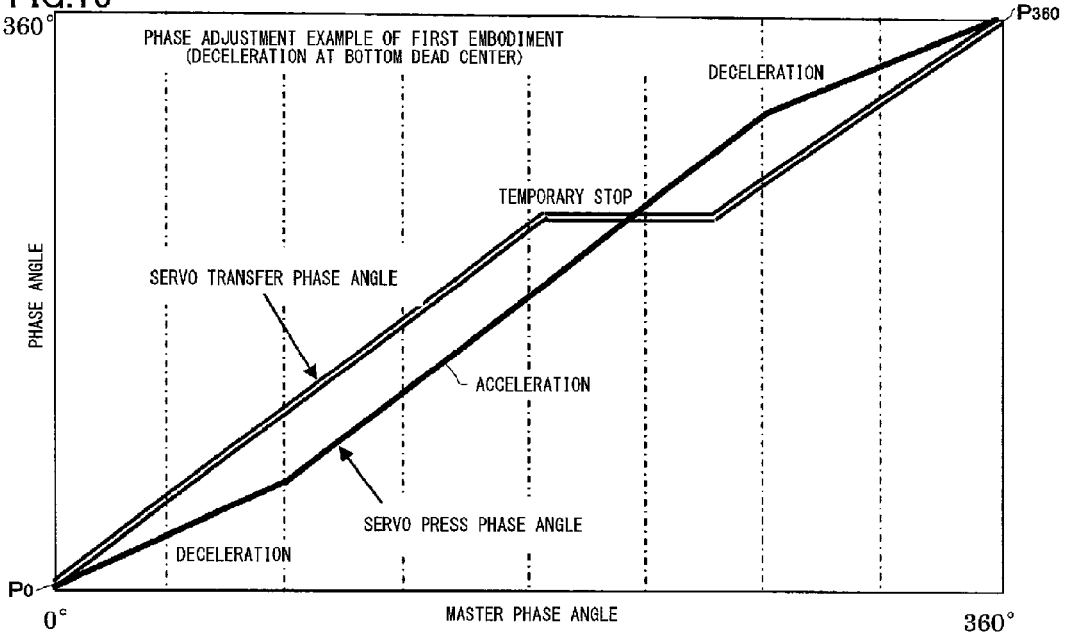
FIG. 10 is a transfer press phase diagram illustrating a phase signal adjustment example according to the first embodiment.

The automatic phase signal adjustment result illustrated in FIG. 10 that can avoid interference may be obtained by adjusting the phase signal as described below. Specifically, the phase signal velocity (e.g., process number advance speed) is set to zero, or reduced (see FIG. 10) between the RTN motion and the CLP motion of the servo transfer device 10. The workpiece CLP (clamp) motion is delayed until press working is completed (see FIG. 11). Specifically, the phase signal relative relationship adjustment section automatically adjusts the transfer phase signal Stmph so that the transfer speed changes in the region other than the workpiece transfer region, but does not change in the workpiece transfer region on condition that the transfer stability priority declaration has been issued.

Figure 11:
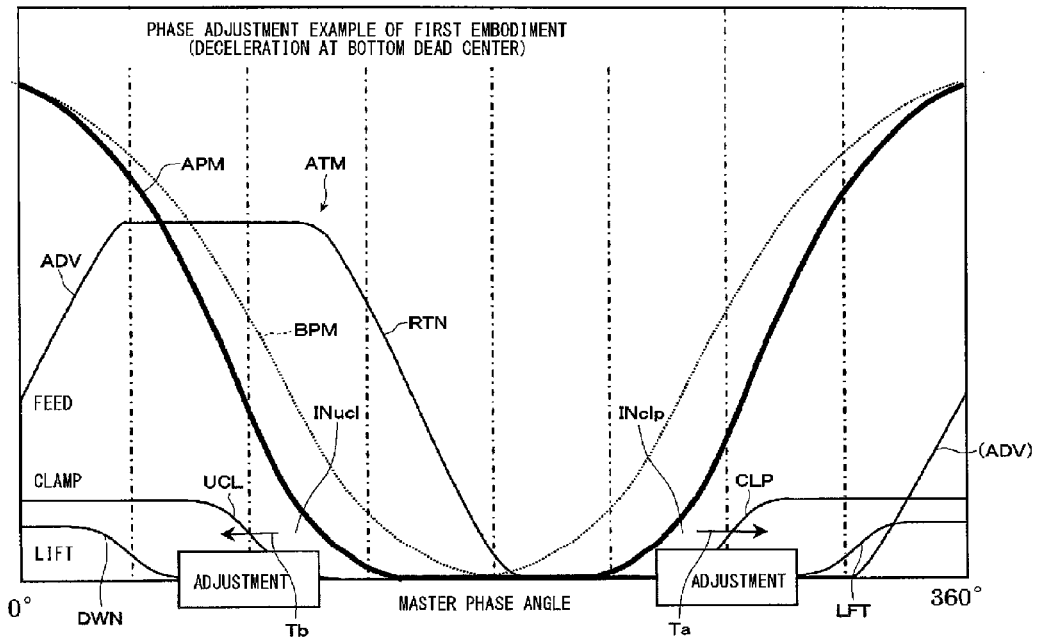
FIG. 11 is a transfer press motion diagram illustrating a phase signal adjustment example according to the first embodiment.

It is necessary to provide a time width similar to that illustrated in FIG. 6 for implementing the ADV motion, the DWN motion, and the UCL motion, or the CLP motion, the LFT motion, and the ADV motion. However, the operation transfer motion ATM illustrated in FIG. 11 is brought forward in the direction indicated by the arrow Tb, and is delayed in the direction indicated by the arrow Ta as compared with the reference transfer motion BTM illustrated in FIG. 6. Therefore, the time width for implementing the transfer motion is increased or ensured by decelerating the press phase signal in the initial stage and the final stage (see FIG. 10). The deceleration period is 0.5 seconds, for example.

Specifically, when the selected press motion has been changed, the phase signal relative relationship adjustment section can adjust the phase signal of the reference transfer motion BTM, and can change the desired selected press motion that has been input (set) in order to avoid interference as long as the desired deceleration at the bottom dead center can be achieved.

When the master phase angle (0° to 360°) that corresponds to one press stroke (horizontal axis in FIG. 6) corresponds to 3 seconds, for example, it takes 4 seconds in total due to the delay time (0.5+0.5=1.0 second) for providing the time width. This means that the press operation speed decreases. It is necessary to prevent such a decrease in productivity.

In the first embodiment, the phase velocity of the press phase signal is increased in order to solve the above problem. The phase velocity of the press phase signal is originally constant (indicated by a straight line that connects points P0 and P360 (see FIG. 10). As illustrated in FIG. 10, the phase velocity of the press phase signal is increased by increasing the linear gradient in the acceleration region so that the transfer press operation time can be reduced by 1 second. Specifically, the transfer press operation can be performed while maintaining the press operation speed at the original value (3 (=4−1) seconds), so that a decrease in productivity can be prevented.

The phase signal relative relationship adjustment section can automatically adjust the press phase signal Spmph so that the press operation speed changes in the non-interference region with the servo transfer device 10, but does not change in the press working region.

As illustrated in FIG. 11, the interference avoidance clearance INucl between the unclamp motion UCL and the operation press motion APM, and the interference avoidance clearance INclp between the clamp motion CLP and the operation press motion APM are sufficiently increased as compared with FIG. 8 by automatically adjusting the press phase signal and the transfer phase signal as described above. This makes it possible to implement a stable transfer press operation while reliably preventing interference.

Second Embodiment

In a second embodiment, the press motion is changed as illustrated in FIGS. 12 to 15 (i.e., short-stroke operation).

Figure 12:
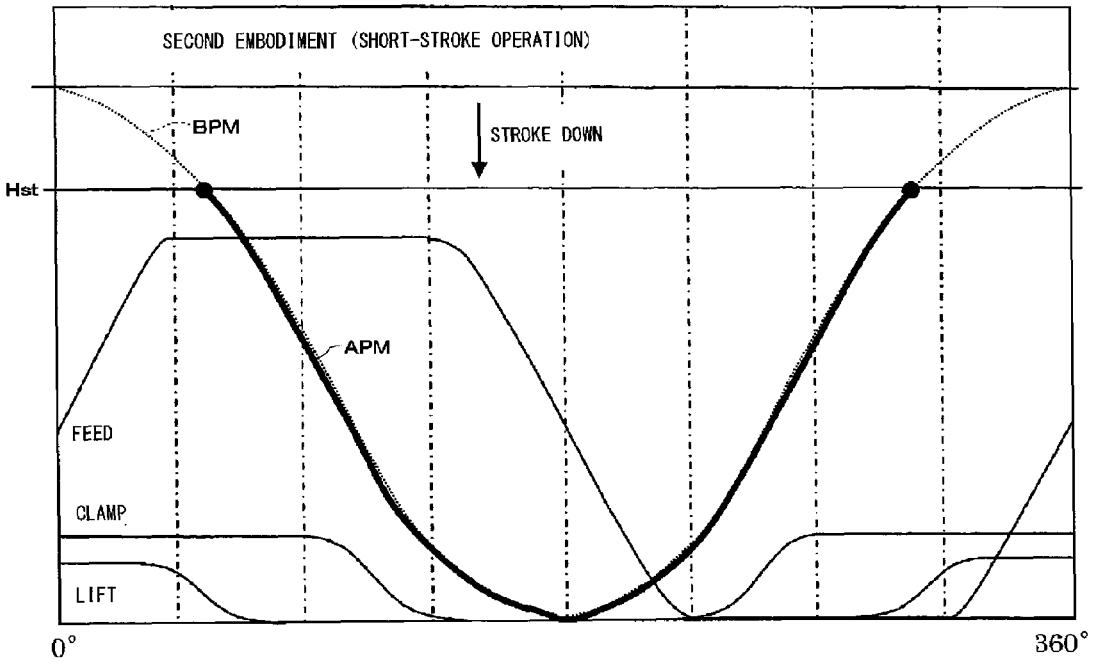
FIG. 12 is a transfer press motion diagram illustrating an operation press motion according to a second embodiment.

When the short-stroke press operation declaration has been issued, the operation press motion APM is set so that the slide stroke decreases (NO in ST20 and ST21 in FIG. 5). The upper limit position of the slide 6 is set to a low position (Hst) illustrated in FIG. 12 that is lower than the top dead center position. The operation press motion APM indicated by the solid line in FIG. 12 is designed so that the upper limit position of the slide 6 is set to the position Hst as compared with the reference press motion BPM indicated by the dotted line (i.e., the upper limit position of the slide 6 is set to the top dead center position). Specifically, the operation press motion APM ends with a short stroke. The operation transfer motion ATM is the same as the reference transfer motion BTM illustrated in FIG. 6.

Figure 13A:
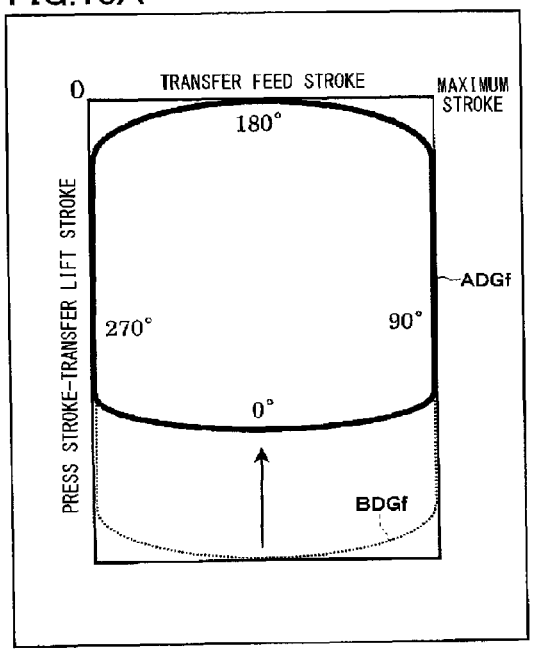
FIGS. 13A and 13B are operation interference diagrams according to the second embodiment.
Figure 13B:
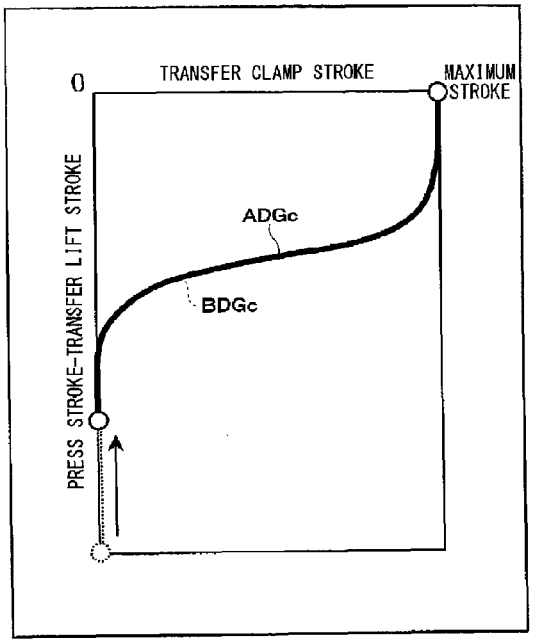
Figure 14:
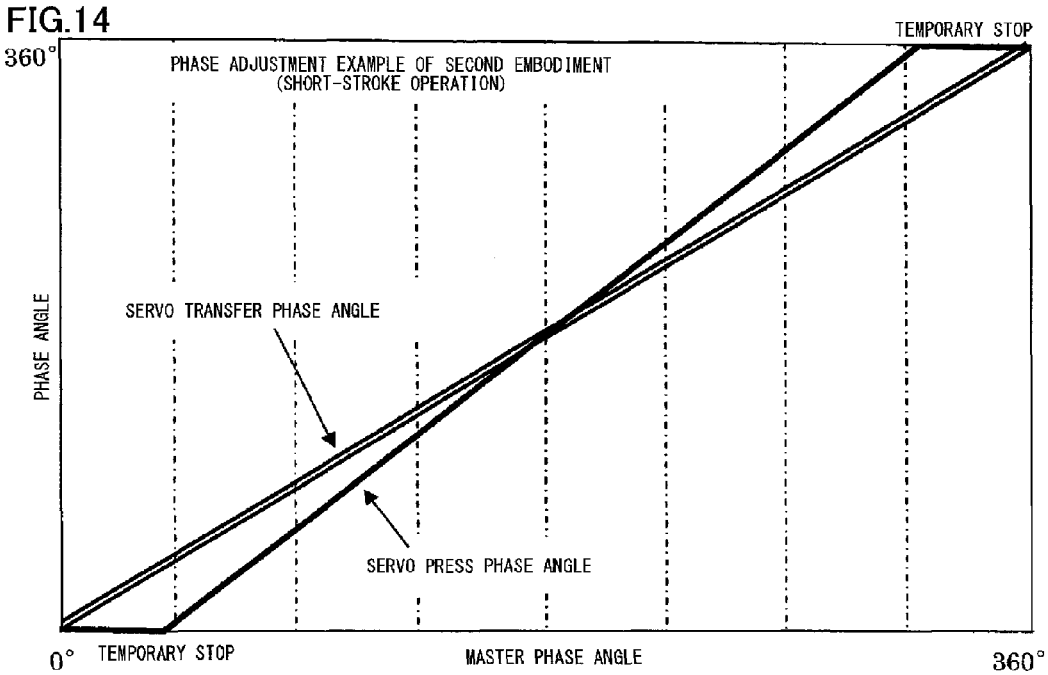
FIG. 14 is a press transfer phase diagram illustrating a phase signal adjustment example according to the second embodiment.

In this case, the operation interference diagram ADGc indicated by the solid line in FIG. 13B is generated. The operation interference diagram ADGc is the same as the reference interference diagram BDGc indicated by the solid line in FIG. 7B. Specifically, since the operation interference diagram ADGc does not overlap the interference protection region, the upper die 7 of the servo press 1 does not interfere with the finger of the servo transfer device 10. The operation interference diagram ADGf indicated by the solid line in FIG. 13A is smaller than the reference interference diagram BDGf indicated by the dotted line (indicated by the solid line in FIG. 7B) due to a short stroke. It is thus obvious that interference does not occur.

When the operation has been set to the short-stroke operation, the phase signal adjustment step (ST27 in FIG. 5) is performed even when interference does not occur. The phase velocity of the phase signal is set to zero in the start region and the end region (see FIG. 14), and the phase signal is automatically adjusted so that the transfer motion time of the servo transfer device 10 is ensured. Specifically, the press phase signal Spmph is adjusted.

Figure 15:
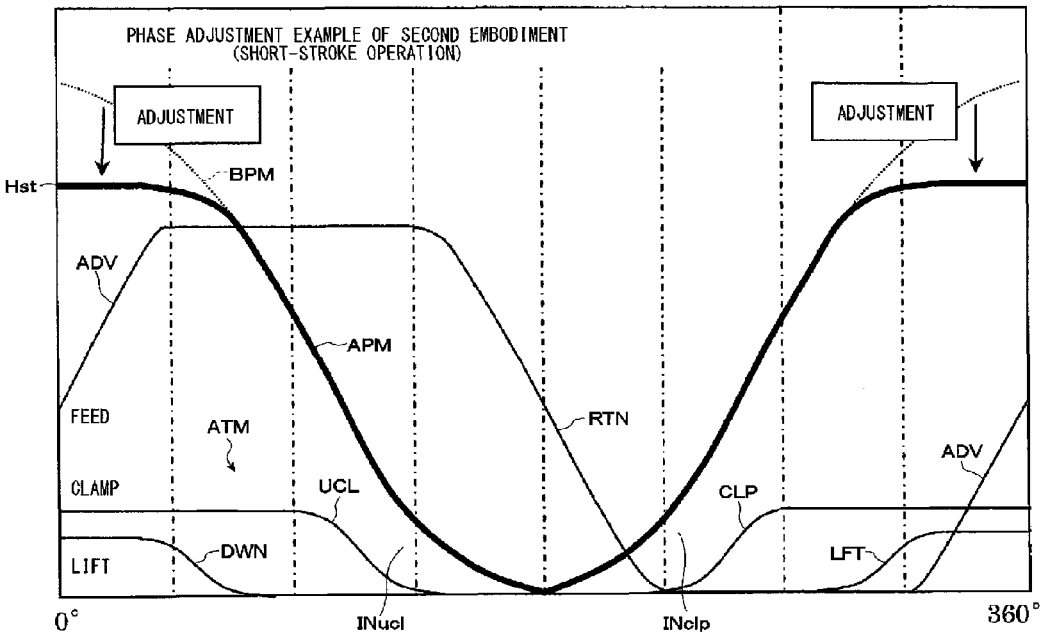
FIG. 15 is a press transfer phase diagram illustrating a phase signal adjustment example according to the second embodiment.
Figure 16:
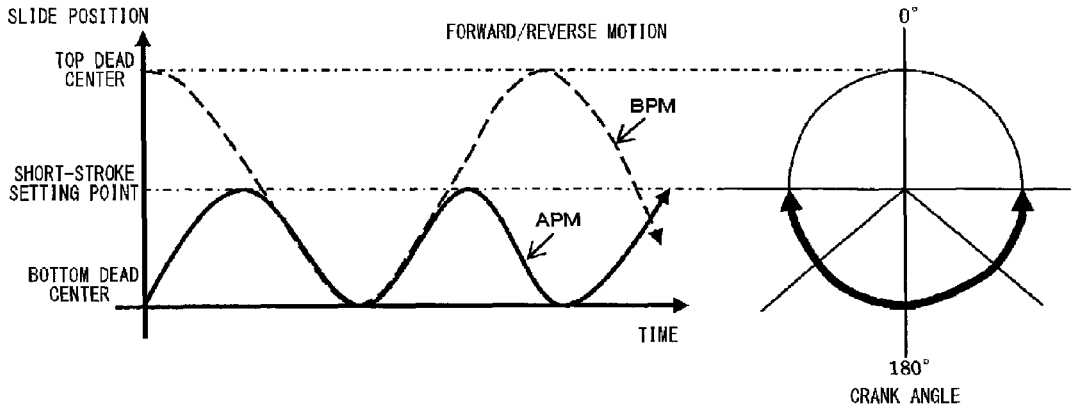
FIG. 16 is a press motion diagram illustrating an example of the operation (forward/reverse) of a servo press.
Figure 17:
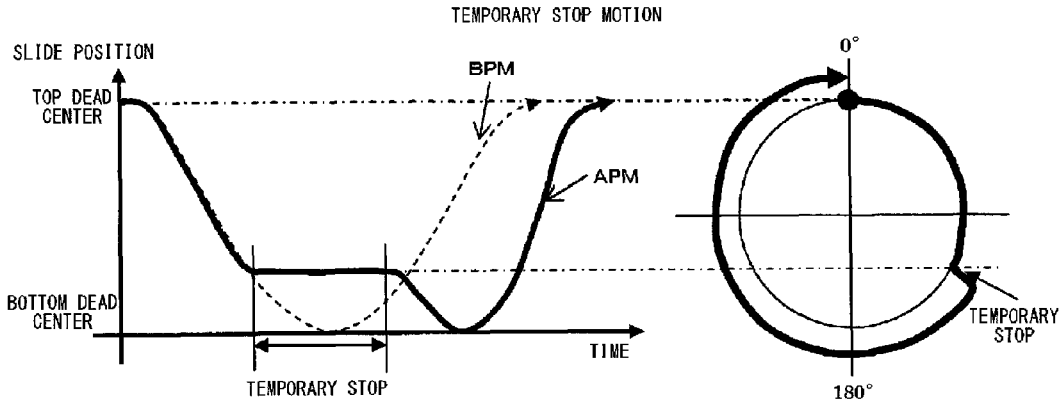
FIG. 17 is a press motion diagram illustrating an example of suspension of a servo press.

As illustrated in FIG. 15 that illustrates the transfer press motion after the automatic phase signal adjustment, a sufficient interference avoidance clearance INucl between the unclamp motion UCL and the operation press motion APM, and a sufficient interference avoidance clearance INclp between the clamp motion CLP and the operation press motion APM are provided.

The workpiece transfer motion time (i.e., the time in which the operation press motion APM stops) can be reduced by increasing the speed of the ADV motion, the DWN motion, the UCL motion, the CLP motion, and the. LFT motion by effectively utilizing the remaining capacity of the servo transfer device 10. Specifically, the cycle time (3 seconds) can be reduced to 2.5 seconds, for example.

In order to implement the above operation, the phase signal relative relationship adjustment section automatically changes the phase velocity of the transfer phase signal Stmph in the workpiece transfer region to the maximum phase velocity when the short stroke determination section has determined that the operation press motion APM is a short-stroke operation press motion. Specifically, the productivity can be improved by the short-stroke operation.

It is possible to allow the servo press 1 to exhibit a satisfactory short-stroke operation capability by increasing the capacity (i.e., transfer speed) of the servo transfer device 10. When the workpiece (e.g., electronic part) is small, and the servo transfer device 10 can be relatively easily modified to achieve a high transfer speed (or replaced with a servo transfer device that achieves a high transfer speed), the productivity can be doubled.

Third Embodiment

In a third embodiment, the transfer press operation is performed so that the workpiece transfer relative positional relationship between the unclamp height (that indicates the workpiece release timing), the clamp height (that indicates the workpiece hold timing), and the press slide height (see the transfer press motion illustrated in FIG. 6 for which avoidance of interference has been confirmed) is maintained constant. The operator issues a workpiece transfer position matching declaration.

When the above transfer press operation has been designated, the phase signal relative relationship adjustment section automatically adjust the press phase signal Spmph and the transfer phase signal Stmph so that the relative positional relationship between the slide height of the servo press 1 immediately after the servo transfer device 10 has held the workpiece, and the slide height of the servo press 1 immediately after the servo transfer device 10 has released the workpiece, is maintained (see FIG. 6). This makes it possible to stably and smoothly transfer the workpiece.

According to the embodiments of invention, since the reference interference diagram generation section, the reference interference diagram storage section 34DG, the operation interference diagram generation section, the interference presence/absence comparison-determination section, and the phase signal relative relationship adjustment section are provided, and the press phase signal Spmph and the transfer phase signal Stmph are automatically adjusted to avoid interference when the motion change request has been issued, it is possible to provide a servo transfer press system that exhibits excellent operability. Since interference between the servo press (e.g., slide or die) and the servo transfer device (e.g., finger) can be reliably prevented even if the motion has been changed, it is possible to arbitrarily change the motion (motion setting) without taking account of avoidance of interference, so that the production efficiency can be significantly improved.

Since the phase signal relative relationship adjustment section automatically adjusts the press phase signal Spmph so that the press speed changes in the non-interference region with the servo transfer device 10, but does not change in the press working region, the press operation speed in the press working region can be maintained irrespective of the motion setting. This makes it possible to arbitrarily set the motion without taking account of the press working quality. Therefore, the operability can be further improved while achieving stable press working quality.

Since the phase signal relative relationship adjustment section automatically adjusts the transfer phase signal Stmph so that the transfer speed changes in the region other than the workpiece transfer region, but does not change in the workpiece transfer region, the transfer operation speed when transferring the workpiece can be maintained irrespective of the motion setting. This makes it possible to arbitrarily change the motion without taking account of a change in workpiece transfer conditions. Therefore, the operability can be further improved while achieving a stable workpiece transfer motion.

Since the phase signal relative relationship adjustment section automatically changes the phase velocity of the transfer phase signal Stmph in the workpiece transfer region to the maximum phase velocity when it has been determined that the operation press motion APM is a short-stroke operation press motion, the press motion speed can be increased by changing the operation press motion APM to a short-stroke operation press motion. Moreover, it is possible to arbitrarily set the motion without taking account of avoidance of interference.

Since the phase signal relative relationship adjustment section automatically adjusts the press phase signal Spmph and the transfer phase signal Stmph so as to maintain the relative positional relationship between the slide height immediately after the workpiece has been held and the slide immediately after the workpiece has been released, it is possible to arbitrarily set the motion without affecting the advanced workpiece transfer setting and taking account of the workpiece transfer motion. It is thus possible to smoothly hold the workpiece that has been held using the pilot pin provided to the upper die 7 of the servo press 1 using the finger of the servo transfer device 10, or hold the workpiece that has been held by the servo transfer device 10 using the servo press 1 (i.e., pilot pin).

Although only some embodiments of the invention have been described in detail above, those skilled in the art would readily appreciate that many modifications are possible in the embodiments without materially departing from the novel teachings and advantages of the invention. Accordingly, such modifications are intended to be included within the scope of the invention.

What is claimed is:

1. A servo transfer press system having a servo press that performs press working and a servo transfer device that transfers a workpiece, generating a press phase signal and a transfer phase signal that are synchronized with a master phase signal, causing the servo press to perform a press operation according to a reference press motion based on the press phase signal, and causing the servo transfer device to perform a transfer operation according to a reference transfer motion based on the transfer phase signal, the servo transfer press system comprising:

a reference interference diagram generation section that generates a reference interference diagram that indicates presence or absence of interference between the servo press and the servo transfer device by using the reference press motion and the reference transfer motion;

a reference interference diagram storage section that stores the reference interference diagram;

an operation interference diagram generation section that generates an operation interference diagram that indicates the presence or absence of interference between the servo press and the servo transfer device by using an operation press motion and an operation transfer motion that have been input before operation;

an interference presence/absence comparison-determination section that compares the operation interference diagram with the reference interference diagram stored in the reference interference diagram storage section, and determines whether or not interference will occur when using the operation interference diagram; and a phase signal relative relationship adjustment section that adjusts a relative relationship between the press phase signal and the transfer phase signal by changing one or both of the operation press motion and the operation transfer motion so that interference will not occur when it has been determined that interference will occur when using the operation interference diagram.

2. The servo transfer press system according to claim 1, wherein the phase signal relative relationship adjustment section automatically adjusts the press phase signal so that a press speed of the servo press changes in a non-interference region with the servo transfer device, but does not change in a press working region.

3. The servo transfer press system according to claim 1, wherein the phase signal relative relationship adjustment section automatically adjusts the transfer phase signal so that a transfer speed of the servo transfer device changes in a region other than a workpiece transfer region, but does not change in the workpiece transfer region.

4. The servo transfer press system according to claim 1, further comprising:

a short stroke determination section that determines whether or not the operation press motion is a short-stroke operation press motion; and a maximum phase velocity setting section that sets a maximum phase velocity of the transfer phase signal that is allowed in a workpiece transfer region, wherein the phase signal relative relationship adjustment section automatically changes a phase velocity of the transfer phase signal in the workpiece transfer region to the maximum phase velocity when the short stroke determination section has determined that the operation press motion is a short-stroke operation press motion.

5. The servo transfer press system according to claim 1, wherein the phase signal relative relationship adjustment section automatically adjusts the press phase signal and the transfer phase signal so that it is possible to maintain a relative positional relationship between a slide height of the servo press immediately after the servo transfer device has held a workpiece, and a slide height of the servo press immediately after the servo transfer device has released a workpiece.

6. The servo transfer press system according to claim 2, wherein the phase signal relative relationship adjustment section automatically adjusts the transfer phase signal so that a transfer speed of the servo transfer device changes in a region other than a workpiece transfer region, but does not change in the workpiece transfer region.

* * * * *